US008063297B2

(12) United States Patent
May

(10) Patent No.: US 8,063,297 B2
(45) Date of Patent: Nov. 22, 2011

(54) MARIMBA SUSPENDED MICROPHONE SYSTEM

(76) Inventor: Randall L May, Irvine, CA (US)

( * ) Notice: Subject to any disclaimer, the term of this patent is extended or adjusted under 35 U.S.C. 154(b) by 99 days.

(21) Appl. No.: 12/540,079

(22) Filed: Aug. 12, 2009

(65) Prior Publication Data

US 2010/0037756 A1 Feb. 18, 2010

Related U.S. Application Data

(60) Provisional application No. 61/088,303, filed on Aug. 12, 2008.

(51) Int. Cl.
*G10H 1/32* (2006.01)

(52) U.S. Cl. ..... 84/723; 84/453; 84/743

(58) Field of Classification Search ..... 84/723
See application file for complete search history.

(56) References Cited

U.S. PATENT DOCUMENTS

| | | | | |
|---|---|---|---|---|
| 3,649,737 | A * | 3/1972 | Jespersen | 84/725 |
| 3,653,625 | A | 4/1972 | Plice | |
| 4,151,777 | A | 5/1979 | Sugiyama et al. | |
| 4,194,096 | A | 3/1980 | Ramsey | |
| 4,396,807 | A | 8/1983 | Brewer | |
| 4,514,598 | A | 4/1985 | Plice | |
| 4,546,950 | A | 10/1985 | Cech | |
| 4,648,302 | A * | 3/1987 | Bozzio | 84/730 |
| 4,791,674 | A | 12/1988 | Drever | |
| 4,903,563 | A | 2/1990 | Mizuguchi | |
| 4,991,220 | A | 2/1991 | Wolf | |
| 5,684,258 | A * | 11/1997 | Liao | 84/421 |
| 5,757,943 | A | 5/1998 | Arledge, Jr. | |
| 6,096,955 | A | 8/2000 | Ter Heide | |
| 6,459,802 | B1 | 10/2002 | Young | |
| 6,881,080 | B2 * | 4/2005 | Macaluso | 439/142 |
| 6,922,475 | B2 | 7/2005 | Hsieh | |
| 2006/0272490 | A1 * | 12/2006 | May | 84/743 |
| 2007/0144329 | A1 * | 6/2007 | Hollander | 84/290 |

* cited by examiner

*Primary Examiner* — Elvin G Enad
*Assistant Examiner* — Christopher Uhlir
(74) *Attorney, Agent, or Firm* — Kirk A. Buhler; Buhler & Associates

(57) ABSTRACT

Improvements in a microphone system for a musical instrument and more particularly for a marimba or similar musical instrument. The microphone system includes a vibration isolation system. A horizontal tracking system bridges across the vertical supports of a marimba in a horizontal tracking system. One or more microphones are supported on the first bridging structure. The microphone(s) are positionally secured on the horizontal tracking system. Both the microphones and the horizontal tracking system provide vibration isolation to all of the microphones. A cable management system is also disclosed to reduce mechanical vibration and eliminate transmission of undesirable sounds.

17 Claims, 5 Drawing Sheets

MARIMBA SUSPENDED MICROPHONE SYSTEM

CROSS REFERENCE TO RELATED APPLICATION

This application claims the benefit of Provisional 61/088,303 filed Aug. 12, 2008 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in supporting microphones securable to a marimba, xylophone and vibraphone. More particularly, the present supporting microphone(s) that is securable to any mallet pitch percussion instruments includes a vibration isolation structure that suspends a tracking system on the illustrated marimba and a separate vibration isolation structure that isolates each microphone from the tracking system.

2. Description of Related Art Including Information Disclosed Under 37 CFR 1.97 and 1.98

Several products and patents have been used to receive the musical sound from a marimba or similar percussion instrument. Most of these devices either are secured to each sound bar or secured to a microphone placed over the sound bars. Exemplary examples of patents covering these products are disclosed herein.

U.S. Pat. No. 4,903,563 issued Feb. 27, 1990 to Masaaki Mizuguchi discloses a sound bar electronic musical instrument such as a marimba. At least some of the sound bars have their own microphone. When a sound bar is struck a tone generator makes the sound through a speaker. This patent does not use all the actual sound from the marimba, the sound is produced from a tone generator.

U.S. Pat. No. 4,151,777 issued May 1, 1979 to Keiicki Sugiyama et al., discloses a piano sound pickup method and device. The pickup and device is placed between a wall of a piano case in opposed direction with a sounding board. The location of the microphone is fixed within the piano and can receive mechanical vibration. Since the single microphone is fixed to a single location there is limited ability to adjust the microphone to receive sound from all of the strings equally or from a particular grouping of strings.

U.S. Pat. No. 6,096,955 issued Aug. 1, 2000 to Jan Anno Ter Heide discloses a device for supporting a musical instrument such as a xylophone, marimba or drum. The structure is a frame having supports on the opposing sides of the musical instrument. The frame legs have wheels or casters that allow the structure, and mounted instrument, to be moved. This patent does not include a microphone or sound pick-up device it provides a frame structure for attaching a xylophone or marimba.

U.S. Pat. No. 3,653,625 on Apr. 4, 1972 to Gerald W. Plice discloses a microphone shock-mounting apparatus. The mounting apparatus uses a cylindrical shock absorber to hold the body shaft of a microphone. This shock absorber is for a microphone and will hold a microphone; the microphone is mountable on a boom fitting or a desk base.

What is needed is an adjustable shock mount base for one or multiple microphones between the resonator tubes. The ideal system would allow a performer to move or adjust the location of the microphones to change the proximity of the microphones to the resonator tubes and the sound bars. This ideal system would isolate mechanical noise and sound from instrument and cable movement. The proposed marimba suspended microphone system satisfies the need with a suspended microphone system that is adjustable by the user.

BRIEF SUMMARY OF THE INVENTION

It is an object of the mallet pitch percussion instruments suspended microphone system to suspend the microphones from shock mounts that isolate unwanted mechanical energy/frequency from the microphones and from the audible sound from those unwanted mechanicals. This reduces or eliminates the frame noise and or sounds when a performer or other person makes contact with the frame where the mallet pitch percussion instruments in mounted. The shock mounting of the microphone(s) is secured to a mounting system that is secured to the frame of the mallet pitch percussion instruments.

It is an object of the mallet pitch percussion instruments suspended microphone system to provide a suspended frame for suspending the microphones. The suspended microphone frame is also shock mounted to the frame of the mallet pitch percussion instruments to further reduce or eliminate mechanical vibration from the frame to the microphones. The suspended microphone frame is preferably removably secured to the mallet pitch percussion instruments frame. The suspended frame is removably secured to the mallet pitch percussion instruments frame with plates placed on the opposing ends of the suspended frame and the hook and loop fasteners, pins that rest in a saddles or similar securing means.

It is an object of the mallet pitch percussion instruments suspended microphone system for the microphones to be positionable on the mallet pitch percussion instruments. The positioning can be by sliding one or more microphones along the suspended tubing. The microphones can also be positioned by altering the angle of the microphone on the mounting hardware.

It is an object of the mallet pitch percussion instruments suspended microphone system for the microphones to be secured with standard microphone mounting that allows a user to mount standard microphones and standard microphone hardware on the isolate frame tube.

It is another object of the mallet pitch percussion instruments suspended microphone system to incorporate a cable management system that retains at least a portion of the microphone cables. The cable management system keeps the cables from moving when the mallet pitch percussion instruments is being moved or played. Movement of the cables creates undesirable mechanical noise that the cable management system significantly reduces or eliminates.

It is another object of the mallet pitch percussion instruments suspended microphone system to include a blend module that allows a performer to mix or blend the sound from one or multiple microphones. A performer may wish to actively alter or change the amplified sound to account for playing style, acoustics or preference. The blend module can accommodate a portion of this need without requiring the performer to climb under the mallet pitch percussion instruments while performing.

It is still another object of the mallet pitch percussion instruments suspended microphone system to secure the microphones in a structure that is fixedly secured to the mallet pitch percussion instruments. The fixed securing will still need to isolate the microphones from mechanical sounds and unwanted percussion sympathetic vibration. The fixedly securing allows the microphones to be moved with the mallet pitch percussion instruments without disassembly of the microphones and or the mallet pitch percussion instruments.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
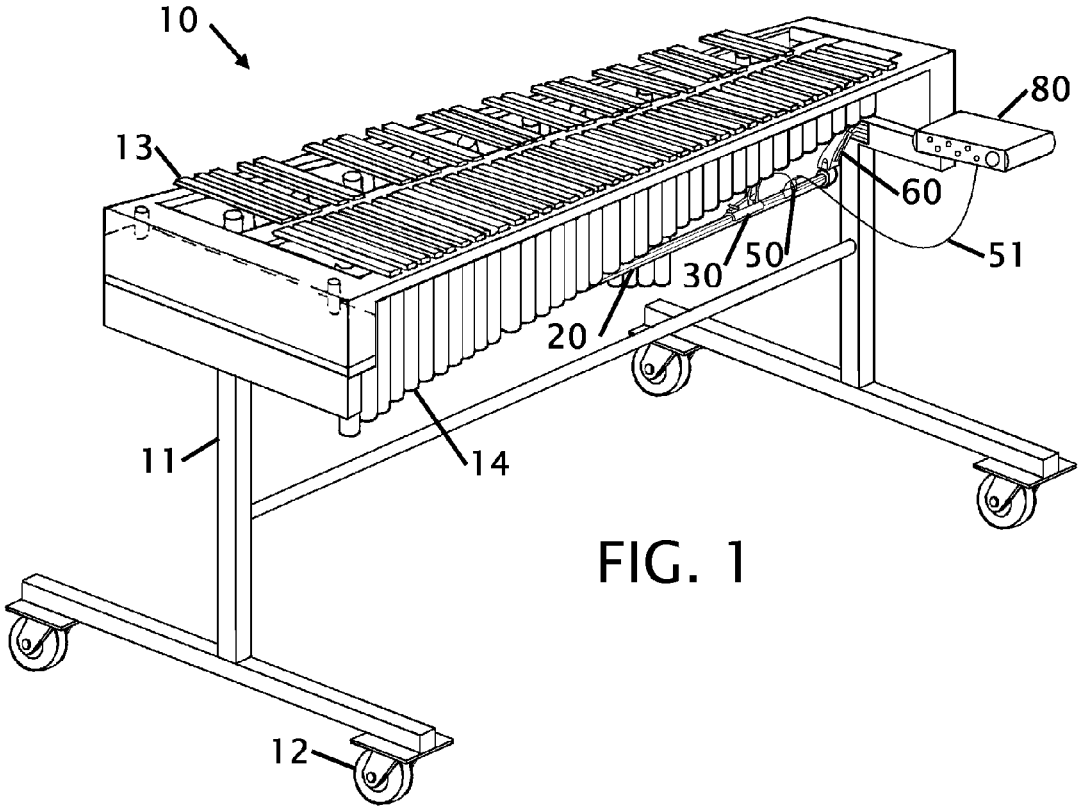
FIG. 1 shows an isometric view of the mallet pitch percussion instruments microphone suspension system mounted on a mallet pitch percussion instruments.

FIG. 1 shows an isometric view of the mallet pitch percussion instruments microphone suspension system mounted on a mallet pitch percussion instruments. While a mallet pitch percussion instruments 10 is shown and described the microphone suspension mounting system is compatible with similarly configured musical instruments including a xylophone. The mallet pitch percussion instruments has a plurality of sound bars 13 with resonance tubes 14 extending under the sound bars 13. Since the performer moves over the top of the sound bars as they strike the sound bars placing a microphone above the sound bars is difficult. In addition, because there are two rows of resonance tubes located under the sound bars, placement of a microphone under or between the resonance chambers is difficult.

In general a mallet pitch percussion instruments support frame 10 is configured on a frame structure 11. The frame structure shown has caster(s) 12 mounted to the bottom of the frame structure 11 to allow the mallet pitch percussion instruments to be moved. The frame structure 11 has upright members that support the mallet pitch percussion instruments 10. The microphone suspension system mounts between the opposing upright legs. A microphone (shown between the resonance tubes) is mounted onto a microphone slide mount 30. The microphone slide mount allows the microphone to be repositioned along the mounting tube or isolated frame tube 20. On the opposing sides of the isolated frame tube 20 are end suspension horns 60 that secure the sub assembly to the mallet pitch percussion instruments. The end suspension horn(s) are shown and described in more detail in FIGS. 2 and 6 herein.

Each microphone has a cord 51 and in this figure the microphone cord 51 loops through a cable management clip 50 before connecting to a mixer blender 80. The mixer blender allows the signal from one or more microphones to be separately amplified and blended before being sent to a power amplifier (not shown). The mixer blender is shown and described in more detail with the inventor's prior application Ser. No. 11/144,542, now U.S. Pat. No. 7,297,863.

Figure 2:
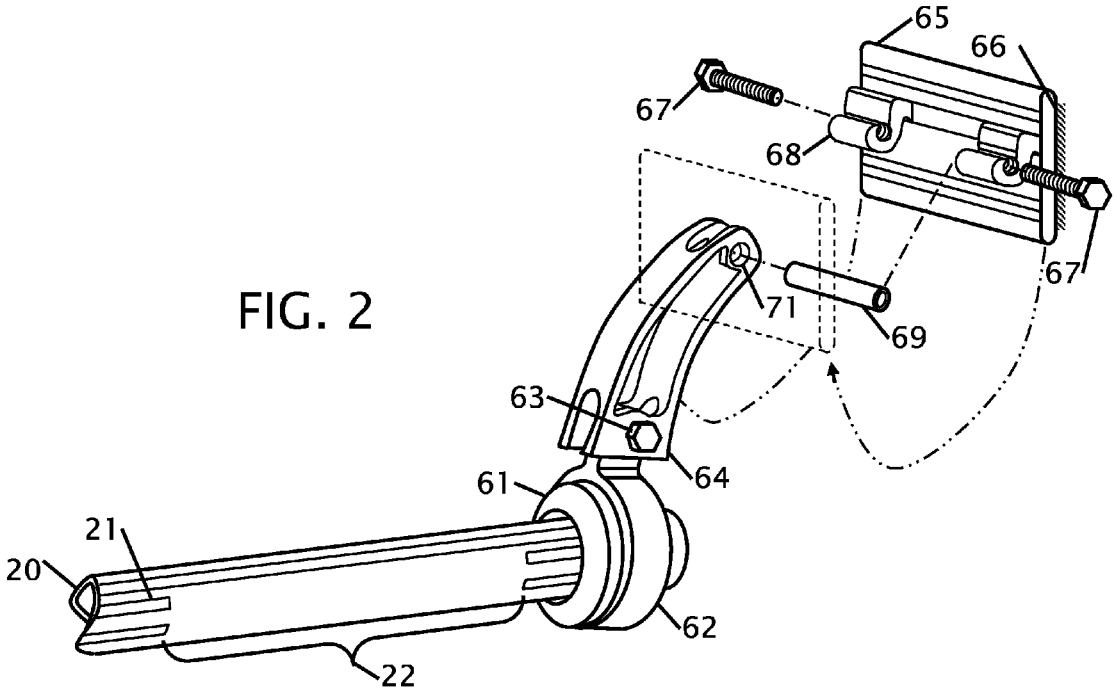
FIG. 2 shows a detailed view of the end support for the isolated frame structure.

FIG. 2 shows a detailed view of the end support for the isolated frame structure. This section of tube 20 can be similarly secured on both ends between the resonance chambers of the mallet pitch percussion instruments. The tube section is fluted or dove tailed 21 to allow elements to slide along the length of the tube without the elements spinning due to gravity or vibration. A portion 22 of the tube has been smoothed to allow dovetailed or fluted elements to be placed onto the flutes or dovetails without requiring a free end of the tube 20. The tube 20 is isolated from the frame with an isolator(s) that fits around the tube 20 ends. The isolator 61 has a support 62 that extends around the isolator 61. The support 62 is fitted onto a horn 64 with a fastener 63. At the end of the horn 64 a pivotable foot 65 (shown exploded from the horn 64) is mounted onto a hollow elastomeric bushing 69 that is passed through hole 71 in the horn 64. The foot 65 is then placed onto the elastomeric bushing 69 and fasteners 67 are threaded into the saddle(s) 68 on the foot 65 where the end of the fastener(s) 67 extends into the hollow elastomeric bushing 69. Various other vibration isolation securing methods are contemplated that provide similar isolation. Some variation include but are not limited to a custom bushing, turning down the end of the threaded portion of the fasteners 67 and placing an additional elastomeric bushing in the connection between the horn 64 and the support 62. In the preferred embodiment the foot 65 uses a hook and loop 66 type fastening system to secure the feet 65 to the mallet pitch percussion instruments frame. The mounting of the tube 20 to the frame 10 provides isolation from mechanical vibration that can be detected by the microphone and subsequently an amplifier.

It is contemplated that the isolator 61, horn 64 and the foot 65 could be made from a single isolation member such as a rubber type material that will provide both rigid support and vibration isolation. The horn and or angled pieces does not need to be made from rigid material such as extruded aluminum but could be molding or a hard rubber extrusion then cut to length finished with a fastener for mounting. While a hook and loop securing system is shown and described other mounting systems are contemplated including but not limited to placing the tube 20 unto a supporting channel or using pins that extend into the sides of the mallet pitch percussion instruments frame.

The transverse tube 20 could also be secured to the frame of the mallet pitch percussion instruments using bungee cords or a transverse trapeze that isolates the tube from the frame of the mallet pitch percussion instruments. The isolation of the tube 20 from the frame 10 provides more omni-directional energy absorbing to minimize or eliminate mechanical noise to the microphones. The fasteners 63 and or 67 can be adjusted to allow the isolated frame tube 20 to swing or rigidly be secured depending upon desire or requirements. As previously identified, the isolation tube 20 is fluted or dovetailed and a portion of the isolation tube 20 has the flutes removed for placement of the microphones.

Figure 3:
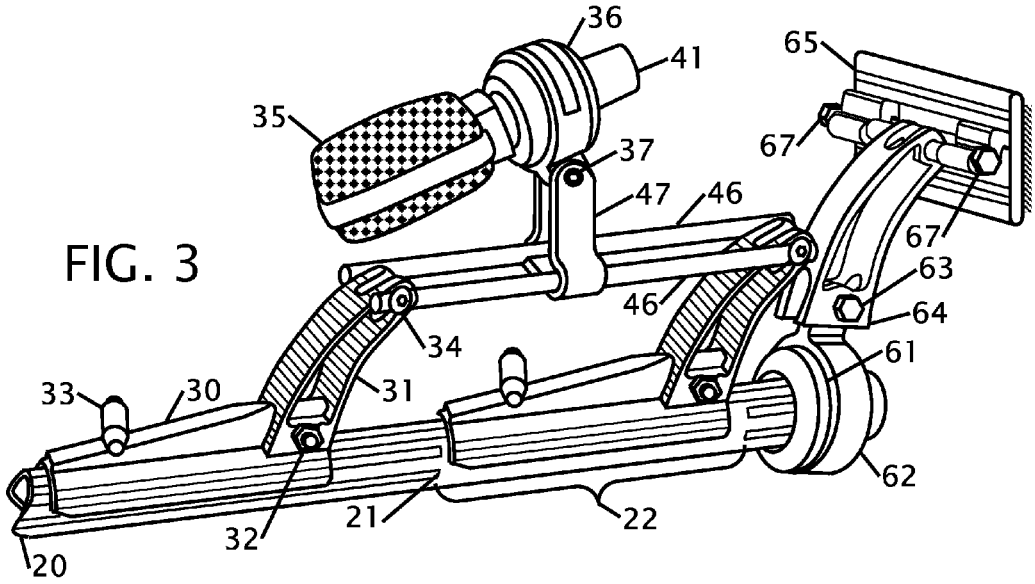
FIG. 3 shows a microphone suspended from a flexible tightrope type cord.

FIG. 3 shows a microphone suspended from a flexible tightrope type cord. The isolated frame tube 20 and its connection with the horn 64 to the foot 65 is the same as described with FIG. 2. In this figure the foot 65 is secured to the bushing and the horn 64 with bolts 67. The horn 64 is fastened to the support 62 with a fastener 63. The isolated frame tube 20 extends through an isolator 61. The tube section of the isolated frame tube 20 is fluted or dove tailed 21 to allow elements to slide along the length of the tube without the elements spinning due to gravity or vibration. A portion 22 of the tube has been smoothed to allow dovetailed or fluted elements to be placed onto the flutes or dovetails without requiring a free end of the tube 20.

The microphone slide support 30 has dovetail inwardly turned edges that engage into corresponding dovetail edges or grooves that are in the isolated frame tube 20. The dovetail edges or grooves maintain the orientation of the microphone and provide a sliding surface for the microphone sub assembly to slide along the isolated frame tube. A lock 33 secures the position of the microphone sub assembly on the isolated frame tube. A horn 31 is secured to the microphone slide mount 30 with a fastener 32 such as a screw, bolt or similar securing means.

Two separate microphone support slides 30 with horns 31 are shown with flexible tightropes 46 stretched between the horns 31 and secured with a clamp or fasteners 34. The tightropes 46 are flexible to dampen unwanted vibration of the frame to the microphones 35. A clamp 47 is secured to the tightropes 46 and a fastener 37 secures the clamp 47 to the isolator 36. The microphone handle slides through the isolator 36 and the cable for the microphone suspension connects to the end 41 of the microphone handle.

Figure 4:
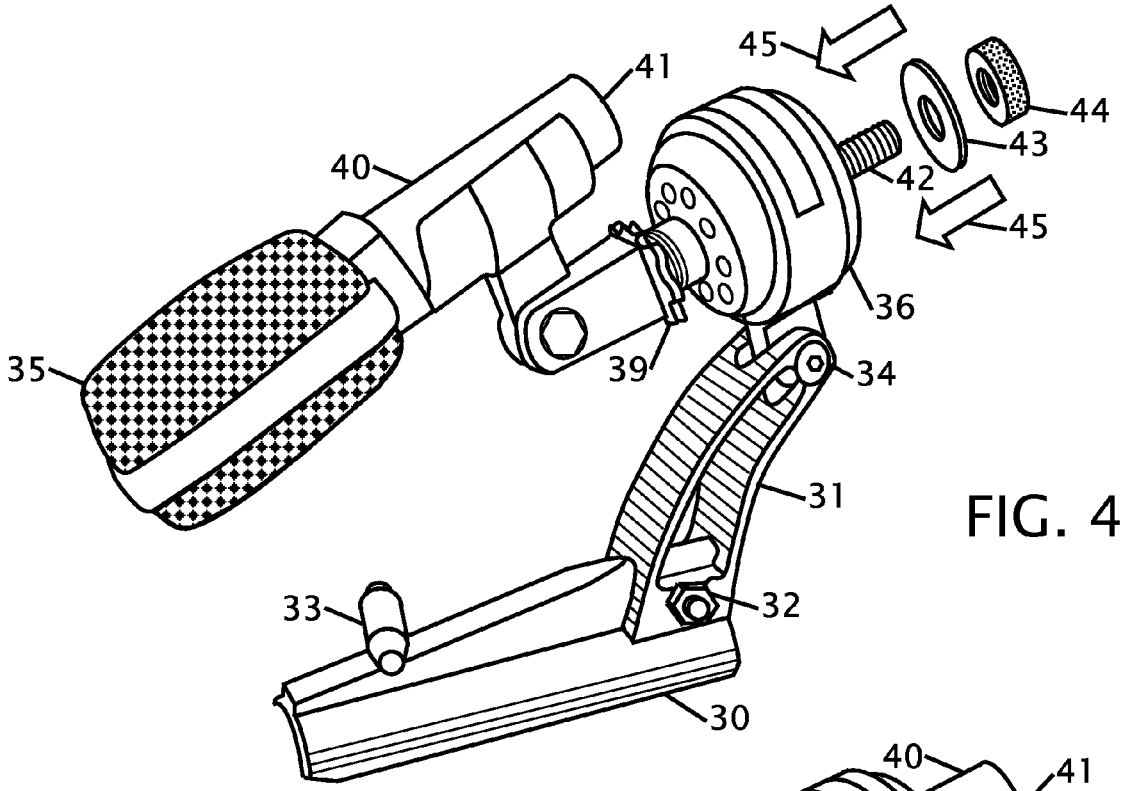
FIG. 4 shows a first preferred embodiment of a microphone mounted into an isolator.
Figure 5:
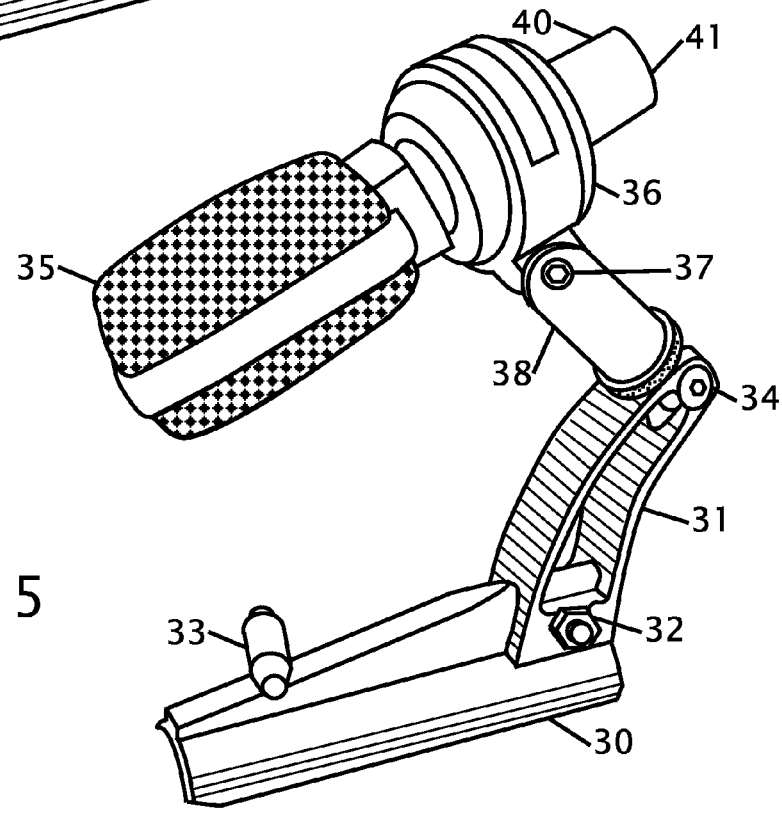
FIG. 5 shows a second preferred embodiment of a microphone mounted into an isolator.

FIG. 4 shows a first preferred embodiment of a microphone suspension mounted into an isolator. FIG. 5 shows a second preferred embodiment of a microphone mounted into an isolator. In both embodiments the base of the sub assembly is a microphone slide support 30. This slide support is similar in construction to the slide support that is used in the instrument carrier disclosed by the inventor in patent application Ser. No. 11/021,596 now U.S. Pat. No. 7,326,842. The slide support 30 engages onto the isolated frame tube 20 in FIGS. 1, 2, 5 and 6. The microphone slide support has dovetail inwardly turned edges that engage into corresponding dovetail edges or grooves that are in the isolated frame tube 20. The dovetail edges or grooves maintain the orientation of the microphone and provide a sliding surface for the microphone sub assembly to slide along the isolated frame tube. A lock 33 secures the position of the microphone sub assembly on the isolated frame tube. A horn 31 is secured to the microphone slide mount 30 with a fastener 32 such as a screw, bolt or similar securing means. The horn 31 is similar in construction to the horn shown and described in the inventor in patent application Ser. No. 11/021,596 now U.S. Pat. No. 7,326,842. Two different types of supporting hardware secure the microphone.

In FIG. 4 an isolator 36 secures the microphone clamp in a microphone stand that is similar in construction to how a microphone would be mounted on a microphone stand. The isolator 36 is secured with a threaded shaft 42 on one end and a thumbnut 39 that thread into the microphone stand base. The microphone mount is secured through the isolator 36 with a threaded shaft 42. A washer 43 and thumb nut 44 is threaded onto the threaded shaft 42. Tightening or loosening the thumbnut down 45 onto the isolator will alter the rigidity of the isolator 36 thereby altering the dampening of mechanical sounds and unwanted percussion sympathetic vibration. The microphone has a screen 35 that covers the pick-up area and a shaft or handle 40 for mounting. The cord would connect to the end 41.

In FIG. 5 the shaft or handle 40 of the microphone is directly mounted into the isolator 36. An extension 38 connects the horn 31 to the isolator 36 using securing hardware 34 and 37 at each end of the extension. The connection cable for the microphone would extend out the end 41 of the shaft or handle of the microphone. While fasteners such as screws are shown and described other types of securing hardware are contemplated including clips, springs, pins, glues, adhesives, snaps or frictional engagement. It is also contemplated that the horn and the microphone holding mechanism can all be made from a rubber material that provides both structural strength and isolation of mechanical vibration.

Figure 6:
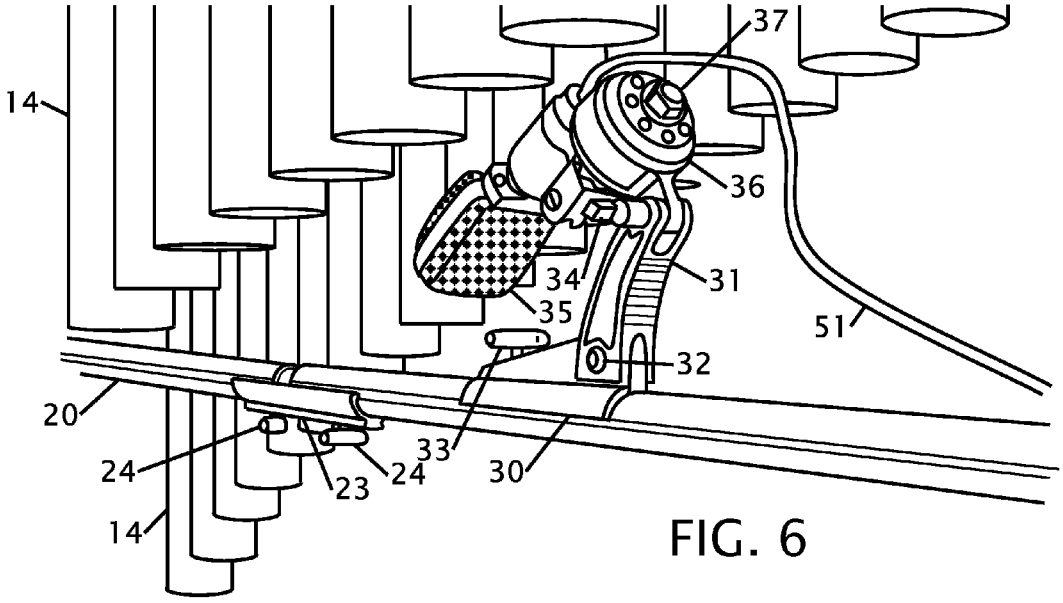
FIG. 6 shows the microphone from FIG. 3 mounted between the resonance tubes on the isolation frame.

FIG. 6 shows the microphone from FIG. 3 mounted between the resonance tubes on the isolation frame. This figure shows the placement of the microphone 35 between the resonance tubes 14 of the mallet pitch percussion instruments. The microphone 35 is mounted onto the isolated frame tube 20 using the microphone slide mount 30 with horn 31. The microphone slide mount 30 can be locked in place on the isolated frame tube 20 with lock 33. Various fasteners 32, 34 and 37 hold the microphone 35 in position. One or more of these fasteners 32, 34 and 37 can be loosened to alter the position and angle of the microphone 35 between the resonance tubes 14. Isolator 36 isolates any mechanical vibration of the mallet pitch percussion instruments frame to the microphone. The microphone cord 51 connects from the back of the microphone through a cable management clip shown in FIG. 7 and then to an amplifier or to a level compensator mixer as shown and described with FIG. 1.

The isolation frame tube 20 is shown in two pieces with a joiner 23 connecting the two isolated frame tube pieces 20. The joiner 20 engages into the dovetail grooves or recesses. This joiner is similar in construction to the joiner shown and described in the inventor's prior patent Ser. No. 11/450,697. Locks 24 secure the position of the joiner 20 onto each of the two isolated frame tube pieces 20.

Figure 7:
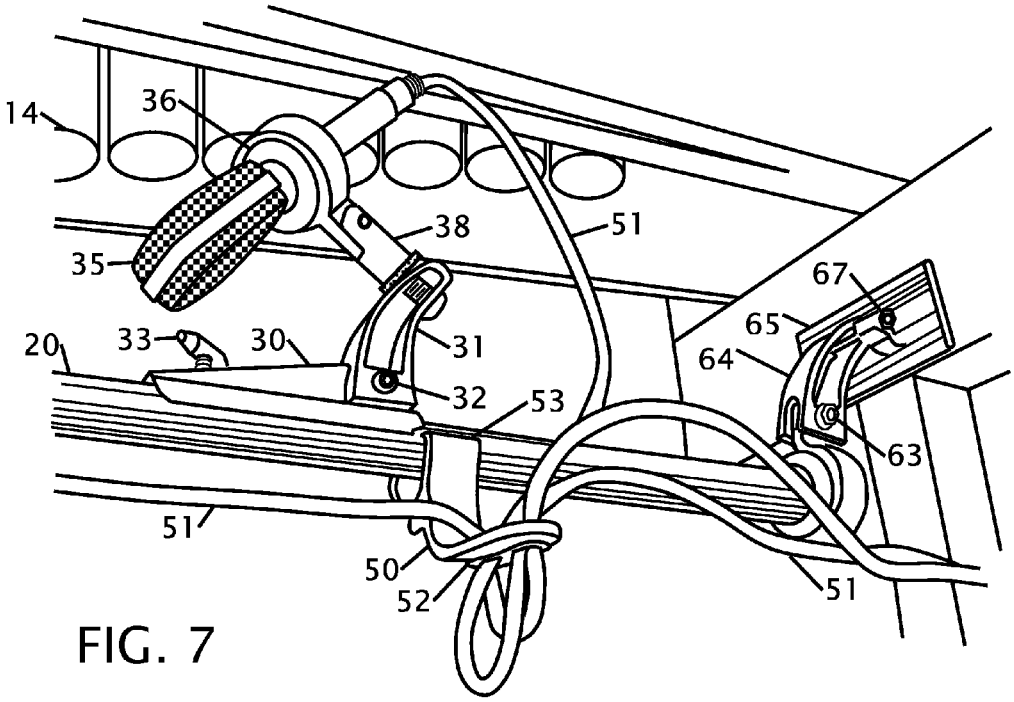
FIG. 7 shows the microphone from FIG. 4 mounted on a mallet pitch percussion instruments with a cable management system.

FIG. 7 shows the microphone from FIG. 5 mounted on a mallet pitch percussion instruments with a cable management system. The microphone and the microphone mounting are similar to previously described configuration where like number correspond to like components. The end suspension horn is similar to previously described configuration where like numbers correspond to like components. The major addition in this figure is the cable management clip 50. In this figure the cable management system is clipped to the dovetail grooves or tabs in the isolated frame tube 20 with clip tabs 53 located at the ends of the cable management clip. The cable management clip 50 prevents or reduces mechanical noise from cable movement from being picked-up or heard in the microphones. An extended tab on the cable management clip 50 has a slot 52 where cables are placed through to capture the cable and to offset gravity and sway of the microphone cable(s) 51.

Figure 8:
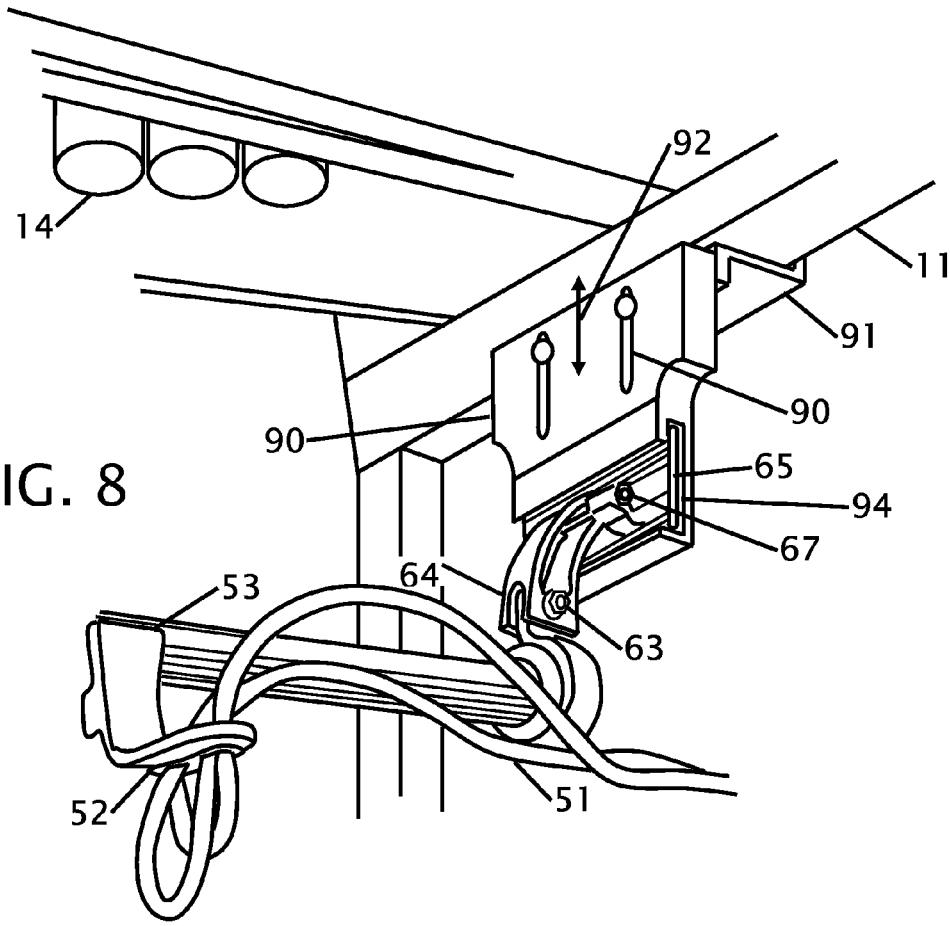
FIG. 8 shows the microphone suspension structure from FIG. 6 with a vertically adjustable frame mounting bracket.
Figure 9:
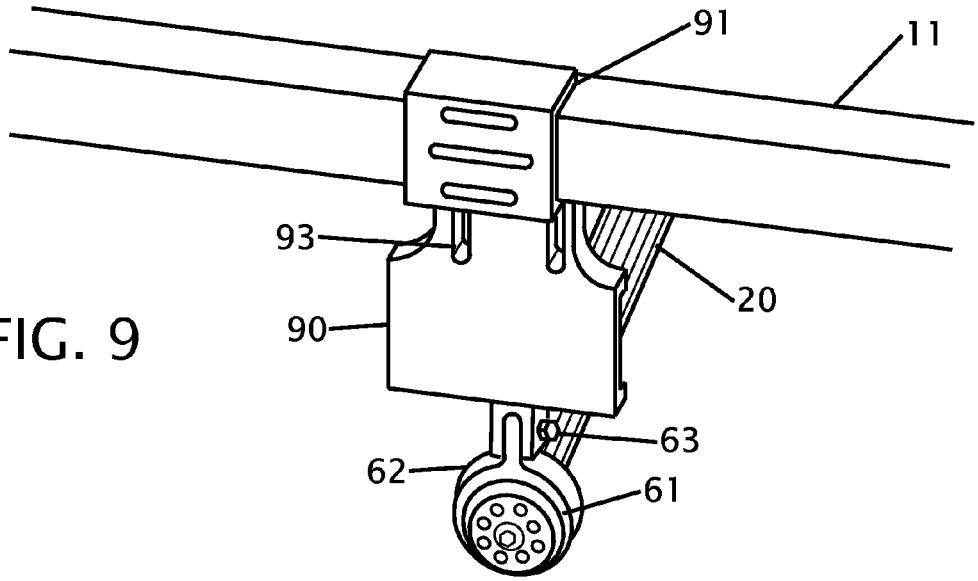
FIG. 9 shows an alternate view of the vertically adjustable frame mounting bracket from FIG. 8.

FIG. 8 shows the microphone suspension structure from FIG. 6 with a vertically adjustable frame mounting bracket and FIG. 9 shows an alternate view of the vertically adjustable frame mounting bracket from FIG. 8. In these figures the foot 65 is shown inserted into the foot retentions hanger 90. The foot is slid into the recess 94 where it is retained. The foot retaining hanger 90 is secured to a frame hook 91 that fits around an existing mallet pitch percussion instruments support frame 11. One or more slots 90 allows the microphone suspension structure to be moved 92 vertically to adjust the height of the microphones between the resonance tubes 14.

Thus, specific embodiments of an isolated mallet pitch percussion instruments microphone system have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A mallet pitch percussion instruments suspended microphone system comprising:

a microphone suspension structure that mounts or integrates to a mallet pitch percussion instruments support frame;

said microphone suspension structure uses an elastomeric isolator between said microphone suspension structure and an existing mallet pitch percussion support frame to support at least one microphone that is securable to said microphone suspension structure;

wherein said microphone suspension structure is at least one elongated rod, or tube, or bar, or extrusion or any combination thereof that is suspended between at least two separate elastomeric isolators;

wherein said at least one elongated rod, tube, bar or extrusion is fluted, and said elastomeric isolator has flutes to engage into said at least one elongated rod, or tube, or bar, or extrusion or any combination to reduce rotation of said at least one microphone.

2. The mallet pitch percussion instruments suspended microphone system according to claim 1 that further includes an elastomeric isolator between said at least one microphone and said microphone suspension structure.

3. The mallet pitch percussion instruments suspended microphone system according to claim 1 that further includes a cable management system that is temporally securable and movable on said microphone suspension structure.

4. The mallet pitch percussion instruments suspended microphone system according to claim 3 wherein said cable management system keeps cables from moving when said mallet pitch percussion instrument is being played or moved to minimize mechanical noise from movement of said cables.

5. The mallet pitch percussion instruments suspended microphone system according to claim 1 that includes at least two microphones.

6. The mallet pitch percussion instruments suspended microphone system according to claim 1 that further includes a mixer blender connected to said at least one microphone.

7. The mallet pitch percussion instruments suspended microphone system according to claim 6 that further includes a mixer blender connected to at least two microphones.

8. The mallet pitch percussion instruments suspended microphone system according to claim 7 wherein said mixer blends, adjusts or equalizes for microphone placement and tonal characteristics.

9. The mallet pitch percussion instruments suspended microphone system according to claim 1 wherein inside of an elastomeric isolator fits around said at least one elongated rod, or tube, or bar, or extrusion or any combination thereof.

10. The mallet pitch percussion instruments suspended microphone system according to claim 9 wherein an outside of said elastomeric isolator is interconnected with a horn.

11. The mallet pitch percussion instruments suspended microphone system according to claim 10 wherein one end of said horn is connected to a pivotable foot.

12. The mallet pitch percussion instruments suspended microphone system according to claim 1 wherein said at least one microphone is positionable on said microphone suspension structure.

13. The mallet pitch percussion instruments suspended microphone system according to claim 12 wherein said positioning is movement of said at least one microphone along said microphone suspension structure between resonance tubes and or vertically between said resonance tubes.

14. The mallet pitch percussion instruments suspended microphone system according to claim 11 wherein said foot secures said microphone suspension structure to said mallet pitch percussion instruments support frame with hook and loop fasteners.

15. The mallet pitch percussion instruments suspended microphone system according to claim 1 wherein said elongated rod, or tube, or bar, or extrusion or any combination is constructed with multiple connectable members.

16. The mallet pitch percussion instruments suspended microphone system according to claim 1 wherein said at least one fluted elongated rod, tube, bar or extrusion has at least one flat surface to allow for insertion and removal of said at least one microphone on at least one fluted elongated rod, or tube, or bar, or extrusion or any combination.

17. The mallet pitch percussion instruments suspended microphone system according to claim 1 wherein said suspended microphone system is mounted between resonance tubes of said mallet pitch percussion instrument.

* * * * *